United States Patent [19]

Joshi

[11] 4,330,424

[45] May 18, 1982

[54] FREE FLOWING BUILDER BEADS AND DETERGENTS

[75] Inventor: David Joshi, Piscataway, N.J.

[73] Assignee: Colgate Palmolive Company, New York, N.Y.

[21] Appl. No.: 234,565

[22] Filed: Feb. 13, 1981

Related U.S. Application Data

[60] Division of Ser. No. 973,962, Dec. 28, 1978, Pat. No. 4,276,326, which is a continuation-in-part of Ser. No. 661,471, Feb. 26, 1976, abandoned.

[51] Int. Cl.[3] ..... C11D 3/075; C11D 3/08; C11D 11/02; C11D 17/06

[52] U.S. Cl. ..... 252/135; 252/174; 252/174.14; 252/174.19; 252/174.21; 252/528; 252/539; 252/540; 427/220

[58] Field of Search ..... 252/91, 135, 174, 174.21, 252/174.14, 528, 542, 547, 540, 174.19; 427/220

[56] References Cited

U.S. PATENT DOCUMENTS

| | | | |
|---|---|---|---|
| 3,334,049 | 8/1967 | Versen | 252/135 |
| 3,454,499 | 7/1969 | Meyer | 252/109 |
| 3,501,408 | 3/1970 | Gabler | 252/135 |
| 3,639,287 | 2/1972 | Gabler | 252/135 |
| 3,639,288 | 2/1972 | Kerkhoven | 252/135 |
| 3,799,880 | 3/1974 | Kelly | 252/110 |
| 3,838,072 | 9/1974 | Smith | 252/540 |
| 3,926,827 | 12/1975 | Mangeli | 252/99 |
| 3,939,100 | 2/1976 | Hau | 252/532 |

*Primary Examiner*—Dennis L. Albrecht

[57] ABSTRACT

A process for producing free flowing spray dried base builder beads comprising inorganic detergent builders. The builder beads comprise alkali metal phosphate, alkali metal silicate and water. The alkali metal phosphate component includes a hydrated and an anhydrous portion. Relatively large amounts of liquid or liquifiable detergent ingredients such as surface active agents etc. can be applied to the base beads after spray drying, without destroying their free flowing properties.

25 Claims, 2 Drawing Figures

1/200"

1/2000"

FREE FLOWING BUILDER BEADS AND DETERGENTS

This is a division of application Ser. No. 973,962 filed Dec. 28, 1978, now U.S. Pat. No. 4,276,326, which is a continuation-in-part of application Ser. No. 661,471 filed Feb. 26, 1976, now abandoned.

The present invention pertains to the manufacture of free flowing detergent builder beads capable of carrying relatively large amounts of various surface active agents and other liquid or semisolid materials. Specifically the invention provides a method for producing spray dried base builder beads that are oversprayed with synthetic detergents such as nonionics, anionics and cationics or combinations thereof to produce granular detergent formulations of improved detergency and solubility and that contain relatively large amounts of the synthetic detergent component while retaining free flowing properties. The invention is particularly useful in providing a granular free flowing detergent having a high content of nonionic synthetic organic detergent. As used herein the terms overspray and post spray are equivalent and should be taken to include any suitable means for applying a liquid or liquifiable substance to the spray dried base builder beads of the invention, including, of course, the actual spraying of the liquid through a nozzle in the form of fine droplets.

BACKGROUND AND PRIOR ART

Typically, nonionic synthetic detergents having the desired detergency properties for incorporation into commercial granular detergent products, such as laundry powders, are thick, viscous, sticky liquids or semisolid or waxy materials. The presence of these materials in a detergent slurry (crutcher mix) prior to spray drying in amounts greater than about 2–3 percent by weight is impractical since the nonionic synthetic detergent will "plume" during spray drying and a significant portion can be lost through the gaseous exhaust of the spray drying tower.

The art has recognized the application of nonionic synthetic detergents of this type to various particulate carrier bases to produce relatively free flowing granular products that can be used as household laundry products. Representative patents containing teachings and disclosures of methods for producing granular free flowing laundry detergents by post spraying a nonionic synthetic organic detergent onto a spray dried particulate product containing detergent builders include; among others: Di Salvo et al U.S. Pat. Nos. 3,849,327 and 3,888,098; Gabler et al U.S. Pat. No. 3,538,004; Kingry U.S. Pat. No. 3,888,781; and British Pat. No. 918,499 (Feb. 13, 1963). The prior art in this regard is typified by post spraying from about 1 to a maximum of 10 percent by weight of a nonionic synthetic detergent onto a spray dried bead that contains a substantial proportion of a surface active agent such as anionic detergents, filler materials, and detergent builders.

Further, certain desirable ingredients for detergent formulations such as cationic surface active agents that provide fabric softening properties and optical brighteners, bluing agents and enzymatic materials cannot be spray dried because of thermal decomposition. Such materials can be incorporated into a granular detergent according to the invention by post spraying them onto the spray dried base builder beads either alone or in addition to a nonionic detergent or other suitable ingredients.

SUMMARY OF THE INVENTION

In one specific aspect the invention provides a method for producing spray dried builder beads that are suitable for carrying relatively large amounts i.e. about 2 to about 40 percent by weight preferably 12 to about 25 percent of various detergent ingredients such as anionic, nonionic, cationic surface active agents, optical brighteners, bluing agents, soil release agents, antiredeposition agents etc. and mixtures thereof. The post added detergent ingredients are applied in liquid form onto the base beads by any suitable means, preferably by spraying in the form of fine droplets from a spray nozzle while the beads are being agitated. In its broadest sense the invention contemplates the post addition or application of any liquid or liquifiable organic substance, that is suitable for incorporation into a laundry detergent formulation, onto spray dried base builder beads comprising inorganic detergent builders.

The new base builder beads of the invention are characterized by spherical or irregularly shaped particles or beads comprising from about 45 to about 80 percent phosphate builder salt, from about 5 to about 15 percent alkali metal silicate solids and from about 5 to about 15 percent water. From about 30 to about 80 percent, preferably 30 to about 50 percent of the alkali metal phosphate component is hydrated in the presence of the alkali metal silicate component and water and the remainder is in anhydrous form. The beads can be classified as solid as opposed to the hollow beads typical of spray dried powders, and have a porous, sponge-like outer surface and a skeletal internal structure.

According to the invention, the post sprayed ingredients are primarily disposed within the particles and is minimally present on the outer surface of the particles. The resulting product is free flowing and without a significant tendency to stick together or agglomerate. Desirably less than about 10 percent by weight of the oversprayed material is present on the outer surface of the final beads.

The free flowing ability of a granular or particulate substance can be measured in relation to the flowability of an equal volume of clean dry sand under predetermined conditions. As would be understood by one skilled in the art, the term percent flowability refers to the comparative flow ratio of equal volumes of experimental material and a control material, with both passing though the same size orifice or other flow restricting passageway.

Although predetermined volumes of test and control materials may be passed through any predetermined sized restriction passageway, the following described procedure was used in arriving at the percent flowability of the present detergents. A two-quart jar equipped with a cap having about a one-inch diameter circular hole therein, was filled with the detergent particles to be tested, and inverted. The time for gravity flow of the contents out of the jar was measured. Subsequentially, the same test was repeated using clean dry sand. The percent flowability of the particular detergent, compared to that of the sand, was calculated by dividing the time required to empty the jar of sand by the time required to empty the jar of the detergent and multiplying this value by one hundred percent.

Although any free flowing material, such as sand may be used as a control material. The present percent flowability figures were obtained using sand which was capable of passing through a 20 on 60 mesh screen (U.S. Sieve) subsequent to it being dried in an oven for approximately two hours at 100° C. and cooled just prior to screening. Typical spray dried detergent powders as presently available on the market have a relative flowability of about 60 in relation to sand i.e. 60 percent of the flowability of sand under the same conditions. Surprisingly the new granular product of the invention has a flowability value of at least about 70 in relation to clean dry sand under the same conditions and up to about 90 or more.

The new base builder beads according to the invention can be further characterized as follows:

Particle size distribution: at least 90% by weight passing through a 20 mesh screen (U.S. series) and being retained on a 200 mesh screen (U.S. series) Density (Sp Gravity): 0.5–0.80 Flowability: 70–100%

The novel base beads of the invention can be produced as follows:

A first quantity of a hydratable alkali metal phosphate builder salt is hydrated in the presence of a second quantity of an alkali metal silicate; the weight ratio of the first quantity to the second quantity being from about 1.5 to about 5. The hydrated phosphate and silicate are mixed in an aqueous medium at a temperature of at least about 170° F. with a third quantity of anhydrous alkali metal phosphate builder salt to form a slurry, or crutcher mix; the weight ratio of the first quantity to the third quantity being from about 0.3 to about 0.7. Various other detergent ingredients i.e. builders such as carbonates, citrates, silicates, etc., and organic builders, and surface active agents can be added to the crutcher mix after the hydration step. According to the invention it is preferred that the presence of organic surface active agents in the crutcher mix be limited to less than 2 percent of the solids present and most preferably that the crutcher mix be free from organic surface active agents. The crutcher mix is agitated and maintained at a temperature from about 170° F. to about 200° F. to prevent any significant hydration of the third quantity of anhydrous phosphate builder salt. Sufficient water is present in the slurry so that the crutcher mix contains from about 40 to about 55 percent solids. Adjuvants such as brighteners, bluing, or other minor ingredients may be present in the crutcher mix if necessary or desirable or may be post added to the spray dried beads.

The crutcher mix is then pumped to a spray tower where it is spray dried in the conventional manner. The spray drying may be performed in a countercurrent or co-current spray drying tower using an air inlet temperature from 500° to 700° F. and a spray pressure from about 200 psig to about 1000 psig. The spray dried product comprises a large plurality of particles having a novel sponge-like structure as opposed to the hollow structure that typically results from spray drying a detergent crutcher mix.

In one of its preferred aspects the invention provides a particulate detergent product that is suitable for the home or commercial laundering of textile materials. The new detergent product is characterized by having a nonionic synthetic organic detergent content of from about 10 to about 40 percent, preferably from about 12 to about 30 percent and most preferably from about 12 to about 25 percent by weight and the absence of filler materials such as alkali metal sulfates that are commonly present in spray dried detergent powders to obtain high spray drying rates. The new granular detergent can be used by itself as a complete laundry detergent or various ingredients such as perfumes coloring agents, bleaches, brighteners, fabric softeners, etc. can be added.

The method for producing the new granular detergent includes the steps of first providing a large plurality of base builder beads having the above mentioned physical characteristics. The nonionic synthetic detergent is then applied on to the spray dried builder beads while they are being agitated, in an amount of from about 10 to about 40 percent by weight of the final product. Nonionic synthetic detergent impregnates the pores or openings on the surface of the beads and passes into the skeletal internal structure; an insignificant amount if any, of the nonionic component remaining on the bead surface. The minimal amount of nonionic detergent on the outer surface of the beads is evidenced by the substantially similar flowability rates obtained for the beads before and after they are sprayed with the nonionic component. A similar process is used to apply other post added ingredients, as disclosed herein, to the spray dried detergent builder beads.

BRIEF DESCRIPTION OF THE DRAWING

The drawing accompanying this application consists of two photomicrographs of a spray dried builder bead or particle according to the invention prior to being post sprayed.

DESCRIPTION OF PREFERRED EMBODIMENTS

Figure 1:
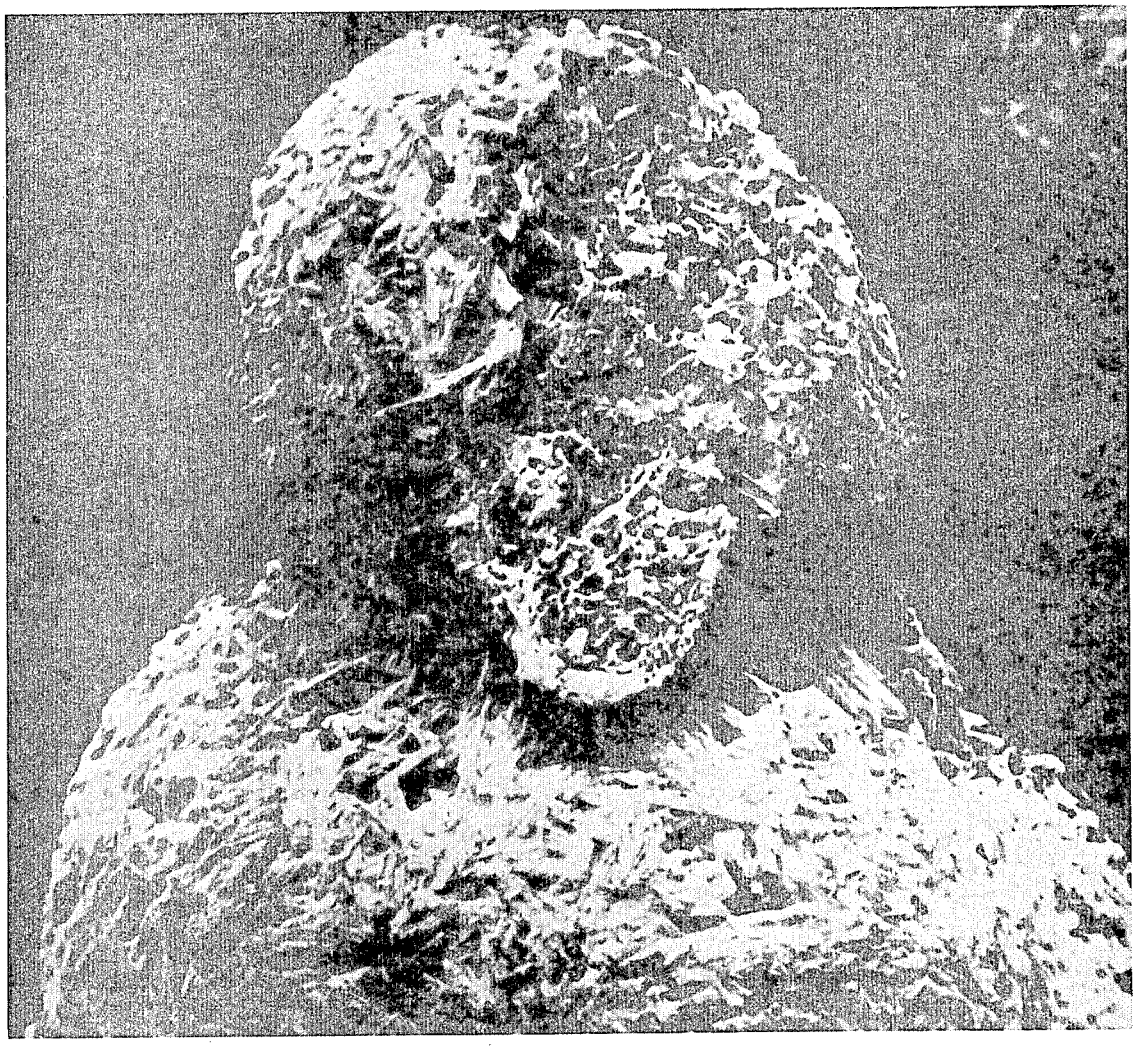
FIG. 1 shows the major portion of a bead according to the invention magnified 200 ×.

As shown in the drawing the new base builder beads comprise solid particles of irregular configuration that have a sponge-like, porous outer surface and a skeletal internal structure. In contrast, conventional spray dried detergent beads such as those currently available on the consumer market typically comprise spherical particles or beads with a substantially continuous outer surface and a hollow core.

The new base builder beads comprise by weight, from about 45 to about 80 percent phosphate builder salt, preferably from about 50 to about 70 percent; from about 5 to about 15 percent alkali metal silicate solids, and from 5 to about 15 percent water. According to a specific aspect of the invention, a substantial portion of the builder salt component of the base beads is the product of hydrating to a maximum degree, typically to the hexahydrate form, from about 30 to 80 percent more particularly 30 to about 60 percent of the phosphate builder salt component in the presence of alkali metal silicate. In further accordance with this specific aspect of the invention, the weight ratio of hydrated phosphate builder salt to alkali metal silicate in both the crutcher mix and base beads is from about 1 to about 8, more preferably 1.5 to about 5, preferably about 2 to about 4, and the weight ratio of hydrated phosphate builder salt to anhydrous builder salt in the crutcher mix and base beads is from about 0.3 to about 0.8, preferably about 0.4 to about 0.6.

In its presently preferred form, the crutcher mix of the invention contains only inorganic detergent builders and water and is free from organic surface active agents. Most preferably the crutcher mix is also free from filler materials such as sodium sulfate.

The alkali metal phosphate builder salt component of the new base builder beads is chosen from the group of phosphate salts having detergent building properties. Examples of phosphate builder salts having detergent building properties are the alkali metal tripolyphosphates and pyrophosphates of which the sodium and potassium compounds are most commonly used. These phosphates are well known in the detergent art as builders and can either be used alone or as mixtures of different phosphates. More specific examples of phosphate builder salts are as follows: sodium tripolyphosphate; sodium phosphate; tribasic sodium phosphate; monobasic sodium phosphate; dibasic sodium pyrophosphate; sodium pyrophosphate acid. The corresponding potassium salts are also examples along with mixtures of the potassium and sodium salts.

The alkali metal silicate component of the crutcher mix is supplied in the form of an aqueous solution preferably containing about 40 to 60 percent by weight typically about 50 percent silicate solids. Preferably the silicate component is sodium silicate with an $Na_2O$:-$SiO_2$ ratio from about 1:1.6 to about 1:3.4 preferably from about 1:2 to about 1:3, and most preferably about 1:2.4.

The overspray ingredients or components can be any liquid or material capable of being liquified that is suitable or desirable for incorporation into a detergent formulation. Suitable materials for overspraying onto the spray dried builder beads of the invention in amounts from about 2 to about 40 percent by weight include, but are not limited to surface active agents, antiredeposition agents, optical brighteners, bluing agents, enzymatic compounds etc.

Suitable surface active agents include anionic and nonionic detergents and cationic, amphoteric or zwitterionic materials. Typical anionic materials include soap, organic sulfonates such as linear alkyl sulfonates, linear alkyl benzene sulfonates, and linear tridecyl benzene sulfonate etc. Representative cationic materials are those having fabric softening or antibacterial properties such as quaternary compounds. These last mentioned cationic materials are particularly suitable for post addition since they might thermally decompose if spray dried as part of a crutcher mix. Examples of quaternary compounds having desirable fabric softening properties are distearyl dimethyl ammonium chloride (available from Ashland Chemical under the trademark Arosurf TA100) and 2-heptadecyl-1-methyl-1-[(2-stearoylamido) ethyl] imidarsolinium methyl sulfate (also available from Ashland Chemical Co. under the trademark Varisoft 475).

The nonionic surface active agent component of the new formulation can be a liquid of semi solid (at room temperature) polyethoxylated organic detergent. Preferably, these include but are not limited to ethoxylated aliphatic alcohols having straight or branched chains of from about 8 to about 22 carbon atoms and from about 5 to about 30 ethylylene oxide units per mole. A particularly suitable class of nonionic organic detergents of this type are available from the Shell Chemical Company under the Trademark "Neodol". Neodol 25-7 (12–15 carbon atom alcohol chain; average of 7 ethylene oxide units) and Neodol 45-11 (14–15 carbon atom chain; average of 11 ethylene oxide units) are particularly preferred.

Another suitable class of ethoxylated aliphatic alcohol nonionic synthetic detergents are available under the Trademark "Alfonic" from Continental Oil Company, particularly Alfonic 1618-65, which is a mixture of ethoxylated 16 to 18 carbon atom primary alcohols containing 65 mole percent ethylene oxide.

Further examples of nonionic synthetic organic detergents include:

(1) Those available under the Trademark "Pluronic". These compounds are formed by condensing ethylene oxide with a hydrophobic base formed by the condensation of propylene oxide with propylene glycol. The hydrophobic portion of the molecule which, of course, exhibits water insolubility, has a molecular weight of from about 1500 to 1800. The addition of polyoxyethylene radicals to this hydrophobic portion tends to increase the water solubility of the molecule as a whole and the liquid character of the product is retained up to the point where the polyoxyethylene content is about 50 percent of the total weight of the condensation product.

(2) The polyethylene oxide condensates of alkyl phenols, e.g., the condensation products of alkyl phenols, having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived from polymerized propylene, dirsobutylene, octene, or nonene, for example.

Other surface active agents that may be suitable are described in the texts, "Surface Active Agents and Detergents", Vol. 11, by Schwarz, Perry and Berch, published in 1958 by Interscience Publishers, Inc., and Detergent and Emulsifiers, 1969 Annual by John W. McCutcheon.

A particularly preferred detergent formulation according to the invention comprises from about 12 to about 30 percent nonionic synthetic organic detergent, most preferably of the polyethoxylated aliphatic alcohol type, oversprayed onto spray dried base builder beads produced according to the method of the invention.

The following examples describe specific embodiments that are illustrative of the invention: (all percentages are by weight unless otherwise specified).

EXAMPLE 1

An aqueous slurry of the following ingredients is prepared.

| Ingredient | Amount, Percent (based on total crutcher mix) |
|---|---|
| Sodium tripolyphosphate powder (anhydrous) | 14.5 |
| Sodium silicate solids ($Na_2O/SiO_2 = 2.4$) | 7.6 |
| Water | 28.6 |

The slurry is brought to a temperature of about 140° F. and mixed well to form the hexahydrate phosphate salt and is subsequently heated to 190° F. and maintained between 190° F. and 200° F. to prevent hydration of the next to be added phosphate ingredient.

The following ingredients are then added to the aqueous slurry at 190° to 200° F. to form a crutcher mix.

| Ingredient | Amount Percent (based on total crutcher mix) |
|---|---|
| Sodium tripolyphosphate powder (anhydrous) | 28.3 |
| Water | 21.0 |

The crutcher mix contains from about 45 to about 50 percent solids by weight.

The crutcher mix is supplied to a countercurrent 8 foot high spray drying tower and is sprayed at a manifold temperature of 180° F. and a pressure of 600–900 psig using a Whirljet 15-1 or Fulljet 3007 spray nozzle.

An air inlet temperature ($T_1$) of about 600° F. is used in the spray tower.

The spray dried base beads produced have the following properties and are similar in internal structure and outer surface characteristics, to the bead shown in FIG. 1.

| Base Bead Properties | |
|---|---|
| Moisture | 10% |
| Tripolyphosphate (Sodium salt) | 77% |
| Silicate Solids | 13% |
| Cup Weight | 130 g. (Sp G. = 0.55) |
| Flow | 86% |
| Tack | 0 |
| Size Analysis: | |
| On U.S. 20 Mesh = | 1% |
| On U.S. 40 Mesh = | 19% |
| On U.S. 60 Mesh = | 50% |
| On U.S. 80 Mesh = | 20% |
| On U.S. 100 Mesh = | 6% |
| On U.S. 200 Mesh = | 3% |
| Through U.S. 200 Mesh = | 1% |
| | 100% |

The base beads are then introduced into a batch rotary drum blender and post sprayed with NEODOL 25-7 at 120° F. and minor ingredients such as coloring agents, perfume, brighteners, etc. to produce a final product as follows:

| | |
|---|---|
| Base Bead (above) | 78 % |
| Neodol 25-7 (at 120° F.) | 19.7% |
| Minors (Color, Perfume, Brightener) | 2.3% |
| | 100.0% |

The Neodol is sprayed first, followed by the minors.

Any suitable batch type blender that has provision for spraying liquids, in the form of fine droplets or as a mist, such as a Patterson Kelly twin shell blender, can be used. The post addition spraying operation can also be performed on a continuous basis using suitable mixing apparatus such as the Patterson-Kelly Zig-Zag blender.

The resulting granular detergent has the following properties:

| FINISHED PRODUCT PROPERTIES | |
|---|---|
| Cup Weight = | 160 g. (Sp G. = 0.68) |
| Flow = | 79% |
| Tack = | 0 |
| Size Analysis | |
| On U.S. 20 Mesh = | 1% |
| On U.S. 40 Mesh = | 20% |
| On U.S. 60 Mesh = | 52% |
| On U.S. 80 Mesh = | 20% |
| On U.S. 100 Mesh = | 5% |
| On U.S. 200 Mesh = | 2% |

-continued

| FINISHED PRODUCT PROPERTIES | |
|---|---|
| Through U.S. 200 Mesh = | 0% |
| | 100% |

The finished product can be packaged on conventional equipment used for packaging granular products.

EXAMPLE 2

An aqueous slurry of the following ingredients is prepared.

| Ingredients (In order of addition) | Amount, Percent (based on total crutcher mix) |
|---|---|
| Hot Water (140° F.) | 25.0 |
| Sodium Silicate Solids ($SiO_2/Na_2O$ = 2.4) | 3.5 |
| Sodium tripolyphosphate powder (anhydrous) | 13.0 |

The aqueous slurry is mixed well in a steam jacketed vessel to hydrate the phosphate ingredient and then heated to 200° F. with steam.

The following ingredients are then added to the aqueous slurry to form a crutcher mix. The temperature is maintained higher than about 180° F. to prevent hydration of subsequently added anhydrous phosphate builder salt.

| Ingredients (In order of addition) | Amount Percent (based on total crutcher mix) |
|---|---|
| Sodium tripolyphosphate (anhydrous) | 13.0 |
| Water | 25.0 |
| Sodium tripolyphosphate (anhydrous) | 13.0 |
| Sodium carbonate | 7.5 |

The crutcher mix is supplied to a countercurrent spray drying tower at a temperature or about 170° F. and sprayed at a presssure of 800 psig. The tower conditions include a $T_1$ (inlet) air temperature of 650° F. and a $T_2$ (outlet) air temperature of about 235° F.

The spray dried builder beads have a particle size distribution such that 90 percent by weight pass through a 20 mesh screen (U.S. series) and 90 percent by weight are retained on a 200 mesh screen (U.S. series).

The spray dried beads are oversprayed according to the technique used in Example 1 as follows:

| Overspray Formula | Amount Percent |
|---|---|
| Spray dried beads | 78.0 |
| Neodol 25-7 | 19.5 |
| Minor ingredients (optical brighteners, perfume etc.) | 2.5 |
| | 100.0 |

The final product has a cup weight of 180 grams; a flow of 75 percent and a water content of 5 percent by weight.

EXAMPLE 3

The procedures of Example 2 are followed with a crutcher mix (about 50 percent solids) of the following composition:

| Ingredient | Amount Percent |
|---|---|
| Sodium tripolyphosphate (hexahydrate) | 13.0 |
| Sodium tripolyphosphate (anhydrous) | 26.0 |
| Water | 47.0 |
| Organic Builder "M" (Monsanto Chemical Co.) | 7.5 |
| Sodium silicate (solids) | 6.5 |
| | 100.0 |

The spray dried builder beads are oversprayed as follows using the technique of Example 1.

| Ingredient | Amount Percent |
|---|---|
| Spray dried builder beads | 85.0 |
| Nonionic (Neodol 45 - 11) | 12.0 |
| Minor Ingredients | 3.0 |
| | 100.0 |

The resulting granular detergent is free flowing, nontacky and suitable for the home or commercial laundering of clothing.

EXAMPLE 4

Example 1 is repeated using Alfonic 1618-65 nonionic detergent in an amount to provide a final granular detergent having a 30 percent by weight nonionic content.

EXAMPLE 5

Crutcher mixes having the following compositions are prepared according to the procedures of Example 1.

| | Amount Percent | | | |
|---|---|---|---|---|
| Ingredient | I | II | III | IV |
| Sodium tripolyphosphate (hexahydrate) | 10 | 12 | 18 | 20 |
| Sodium silicate solids ($SiO_2/Na_2O = 2.4$) | 3 | 8 | 6 | 4 |
| Sodium tripolyphosphate (Anhydrous) | 30 | 30 | 26 | 28 |
| Water | 57 | 50 | 50 | 48 |

Crutcher mixes I, II, III, and IV are spray dried according to the procedures outlined in Example I. The spray dried beads are oversprayed as follows:

| | Amount Percent | | | |
|---|---|---|---|---|
| Ingredient | I | II | III | IV |
| Spray dried beads | 74.5 | 80.5 | 59 | 83 |
| Minor ingredients | 0.5 | 1.5 | 1 | 2 |
| Neodol 45-11 | — | 18.0 | — | — |
| Neodol 25-7 | 25.0 | — | 40 | — |
| Alfonic 1618-65 | — | — | — | 15 |

The resulting granular detergents from runs I, II, III, and IV are free flowing and are very soluble in wash water.

EXAMPLE 6

Spray dried base builder beads produced from crutcher mixes I–IV of example 5 are oversprayed as follows:

| | Amount (Percent) Crutcher Mix | | | |
|---|---|---|---|---|
| Ingredient | I | II | III | IV |
| Spray dried base builder beads | 94 | 79.9 | 73.5 | 79.4 |
| Neodol 25-7 | — | 15 | 20 | 12 |
| Linear tridecyl benzene sulfonate | — | 3 | — | 5 |
| AROSURF TA100 (sprayed at 180–210° F.) | 6 | — | 4 | 2 |
| Bluing agent | — | 0.1 | — | 0.1 |
| Optical brightener | — | 2 | 1.5 | 1 |
| Enzymatice compound (dispersed in a vehicle) | — | — | 1 | 0.5 |

The formulations II, III, and IV are suitable for use as laundry detergents. The formulation I is a fabric softener that can be used in a washing machine.

The various post spray drying ingredients of example 6 and those of the other examples can be applied to the base beads either separately or in any suitable combination.

The present process allows the production of free-flowing detergent beads by a method which does not produce pollution (fuming or pluming) and which is economically feasible, with high throughputs, utilizing conventional plant equipment. In addition to making a free-flowing product, the product made is also nontacky and has improved water solubility relative to prior art detergent powders. Lengthy aging periods are not necessary for the spray dried detergent intermediate beads before they can be treated with the aforementioned overspray ingredients and such aging periods are not needed before filling may be effected. With various other methods for making detergent particles containing nonionics, such aging or curing periods are required, thereby slowing production and causing tying up of storage facilities.

The invention has been described with reference to various specific and preferred embodiments and techniques. However, it should be understood that many variations and modification may be made within the scope of the invention, which is defined by the following claims.

I claim:

1. A free flowing particulate base bead for a detergent composition having an internal skeletal structure and a porous outer surface produced by:

(a) hydrating a first quantity of anhydrous phosphate builder salt to the maximum in the presence of an alkali metal silicate using sufficient water to form an aqueous slurry;

(b) adding a second quantity of anhydrous phosphate builder salt to said aqueous slurry to form a crutcher mix, said addition being made under conditions which maintain said second quantity of phosphate builder in an anhydrous state; and (c) spray drying said crutcher mix to form a particulate material, the weight ratio of said first quantity of builder salt to said alkali metal silicate being from about 1.5 to about 5 and the weight ratio of said first quantity of builder salt to said second quantity of builder salt being from about 0.3 to about 0.7.

2. The bead of claim 1 wherein said aqueous slurry is heated to a temperature from about 170° F. to about 200° F.

3. The base bead of claim 1 wherein additional water is added to said aqueous slurry with the addition of said second quantity of anhydrous phosphate.

4. The base bead of claim 1 wherein said hydrating step is performed at a temperature suitable for hydrating said first quantity of phosphate builder salt to a maximum and said slurry is then raised to a temperature that would prevent any significant hydration of said second quantity of phosphate builder salt.

5. The base bead of claim 1 wherein the weight ratio of said first quantity of said second quantity off anhydrous phosphate builder salt is about 0.5.

6. The base bead of claim 1 wherein said crutcher mix contains from about 40 to about 55 percent solids.

7. The base bead of claim 1 wherein said spray drying takes place in a countercurrent spray tower at a spray pressure from about 200 psig to about 1000 psig and an inlet air temperature from about 500° F. to about 700° F.

8. The base bead of claim 1 wherein up to 10 percent by weight based on the curtcher solids, of builder salts is added, said builder salts being chosen from the group consisting of carbonates, citrates and silicates having detergent building properties or combinations thereof.

9. The base bead of claim 1 wherein a quantity of a liquid or semi-solid nonionic detergent material is sprayed onto said bead such that said nonionic detergent impregnates said bead, said quantity of nonionic being about 10 to about 40 percent by weight of said base bead.

Figure 2:
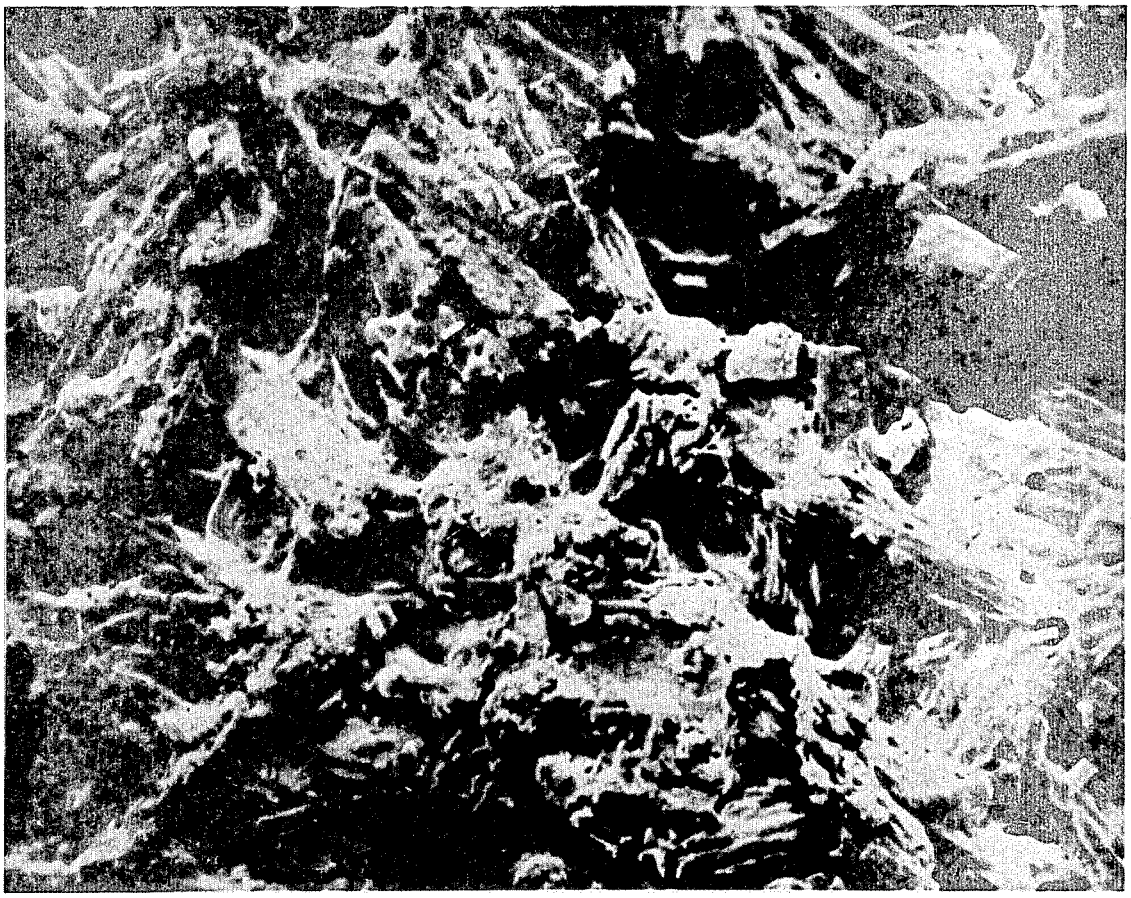
FIG. 2 shows a cut away portion of the bead of FIG. 1 magnified 2000 ×.

10. A free flowing base builder bead produced by a process comprising the steps of:

(a) hydrating a first quantity of anhydrous phosphate builder salt in the presence of an alkali metal silicate to form an aqueous slurry; and (b) adding a second quantity of anhydrous phosphate builder salt to said aqueous slurry to form a crutcher mix; and (c) spray drying said crutcher mix to form a particulate material, the weight ratio of said first quantity of builder salt to said alkali metal silicate being from about 1.5 to about 5 and the weight ratio of said first quantity of builder salt to said second quantity being from about 0.3 to about 0.7; said base builder bead having an exterior surface substantially as depicted by FIG. 1, and an interior structure substantially as depicted by FIG. 2.

11. A free flowing bead according to claim 10 wherein said base builder bead comprises by weight from about 45 to 80 percent phosphate builder salt; from about 5 to 15 percent alkali metal silicate solids, and from about 5 to 15 percent water.

12. A free flowing bead according to claim 11 wherein said base builder bead comprises by weight from about 50 to 70 percent phosphate builder salt.

13. A free flowing bead according to claim 10 wherein the weight ratio of hydrated phosphate builder salt to alkali metal silicate in the crutcher mix and in the base bead is about 2 to 4; and the weight ratio of hydrated phosphate builder salt to anhydrous phosphate builder salt in the crutcher mix and in the base bead is from about 0.4 to about 0.6.

14. A free flowing bead produced by a process according to claim 10 which further includes the step of heating said aqueous slurry to a temperature from about 170° F. to about 200° F. before adding the second quantity of phosphate builder salt.

15. A free flowing bead produced by a process according to claim 10 which further includes the addition of water along with the addition of the second quantity of phosphate builder salt.

16. A bead produced by a process according to claim 10 wherein said hydrating step is performed at a temperature suitable for hydrating said first quantity of phosphate builder salt and said slurry is raised to a temperature that would inhibit hydration of said second quantity of phosphate builder salt.

17. A bead according to claim 10 wherein the weight ratio of said first quantity of said second quantity of anhydrous phosphate builder salt is about 0.5.

18. A bead according to claim 10 wherein the weight ratio of said first quantity of said phosphate builder salt to said alkali metal silicate is about 2 to about 4.

19. A bead according to claim 10 wherein said crutcher mix contains from about 40 to about 55 percent solids.

20. A bead produced by a process according to claim 10 wherein said spray drying takes place in a countercurrent spray tower at a spray pressure from about 200 psig of about 1000 psig and an inlet air temperature from about 500° F. to about 700° F.

21. A free flowing particulate detergent composition containing from about 10 to 40 percent by weight of a liquid or semi-solid nonionic detergent material prepared by the process of treating the base builder beads according to claim 10 by a step comprising applying said nonionic detergent onto said beads such that said nonionic detergent impregnates said beads.

22. A detergent composition according to claim 21 wherein said base builder beads comprise from about 45 to about 80 percent by weight phosphate builder salt; from about 5 to about 15 percent alkali metal silicate solids and from about 5 to about 15 percent water and said nonionic is present in an amount of from about 12 to about 25 percent by weight.

23. A detergent composition according to claim 21 wherein said builder beads are substantially free from organic surface active agents.

24. A detergent composition according to claim 21 wherein said applying step includes spraying said nonionic detergent material onto said builder beads while they are being agitated.

25. A free flowing particulate detergent composition containing from about 2 to about 40 percent by weight of an organic material chosen from the group consisting of anionic, nonionic and cationic surface active agents and mixtures thereof produced by:

(a) hydrating to a maximum a first quantity of anhydrous phosphate builder salt in the presence of an alkali metal silicate using sufficient water to form an aqueous slurry;

(b) said hydrating step being performed at a temperature of at least about 140° F. and not greater than about 170° F;

(c) the weight ratio of said first quantity of builder salt to said silicate being from about 1.5 to about 5;

(d) raising the temperature of said aqueous slurry to more than about 170° F. and less than about 200° F;

(e) adding a second quantity of anhydrous phosphate builder salt to said aqueous slurry to form a crutcher mix, the weight ratio of said first quantity of builder salt to said second quantity of builder salt being from about 0.3 to about 0.7;

(f) supplying said crutcher mix to a spray drying tower;

(g) said aqueous slurry and said crutcher mix being maintained at temperatures of at least about 170° F. through steps (e) and (f);

(h) spraying said crutcher mix in said spray tower to produce spray dried base beads, each bead having an internal skeletal structural and a porous outer surface; and (i) applying said organic material to said base beads such that said organic material is disposed within said base beads.

* * * * *